United States Patent [19]

Hickey

[11] 4,239,212

[45] Dec. 16, 1980

[54] PUSH-PULL EXERCISE DEVICE

[76] Inventor: Donald D. Hickey, 317B Hayden St., Sayre, Pa. 18840

[21] Appl. No.: 35,638

[22] Filed: May 3, 1979

[51] Int. Cl.[3] ..... A63B 21/02

[52] U.S. Cl. ..... 272/141; 272/DIG. 4; 272/137; 272/DIG. 5

[58] Field of Search ..... 272/137, 141, 142, 143, 272/DIG. 4, 70.1, 70.3, 138

[56] References Cited

U.S. PATENT DOCUMENTS 3,633,908 1/1972 Krauth ..... 272/141 X

FOREIGN PATENT DOCUMENTS 860811 1/1971 Canada ..... 272/141

*Primary Examiner*—Richard C. Pinkham
*Assistant Examiner*—William R. Browne
*Attorney, Agent, or Firm*—William Preston Hickey

[57] ABSTRACT

A push pull exercise device having two sets of coil springs telescoped around respective members of parallel sets of rods that are moved endwise to each other. Pulling forces on the rods are opposed by one set of the springs, and pushing forces on the rods are opposed by the other set of springs. The device can be quickly knocked down to a package of parallely touching parts.

9 Claims, 5 Drawing Figures

PUSH-PULL EXERCISE DEVICE

BACKGROUND OF THE INVENTION

The present invention relates to exercise devices, and more particularly to exercise devices for those patients requiring physical therapy. I am aware that a number of devices have been provided by the prior art wherein tension coil springs are pulled against for exercising the arm muscles. I am aware that exercise devices have been provided for the hand wherein U-shaped springs are compressed to exercise the hand. In another device with which I am aware, elastic cords are provided to resist pulling forces, and when the device is rotated at ninety deprees, compression springs are brought into position for exercising the arm muscles in the reverse direction.

None of the devices with which I am aware can be used to exercise both abductor muscles and adductor muscles without changing devices, or changing positions, or both. Patients recovering from severe illnesses or operations, and having damaged muscles of the body, have a need for exercise devices that are light and compact so that they can be taken to the patient rather than have the patient move to a physical therapy facility.

Accordingly, it is an object of the present invention to provide a portable lightweight hand held exercise device to exercise both abductor muscles and adductor muscles of the entire body including the arms, legs, and torso.

Another object of the present invention is the provision of a new and improved exercise device of the above described type which can be quickly changed to absorb different amounts of force per unit deflection.

A still further object of the present invention is the provision of a new and improved portable lightweight hand held exercise device which can be easily disassembled and assembled to facilitate shipment in a knocked down condition.

Further objects and advantages of the invention will become apparent to those skilled in the art to which the invention relates from the following description of several preferred embodiments.

DESCRIPTION OF THE PREFERRED EMBODIMENT

Figure 1:
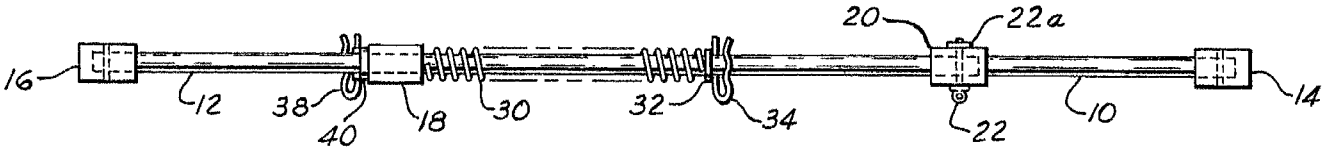
FIG. 1 is a side elevational view of one embodiment of the present invention.
Figure 2:
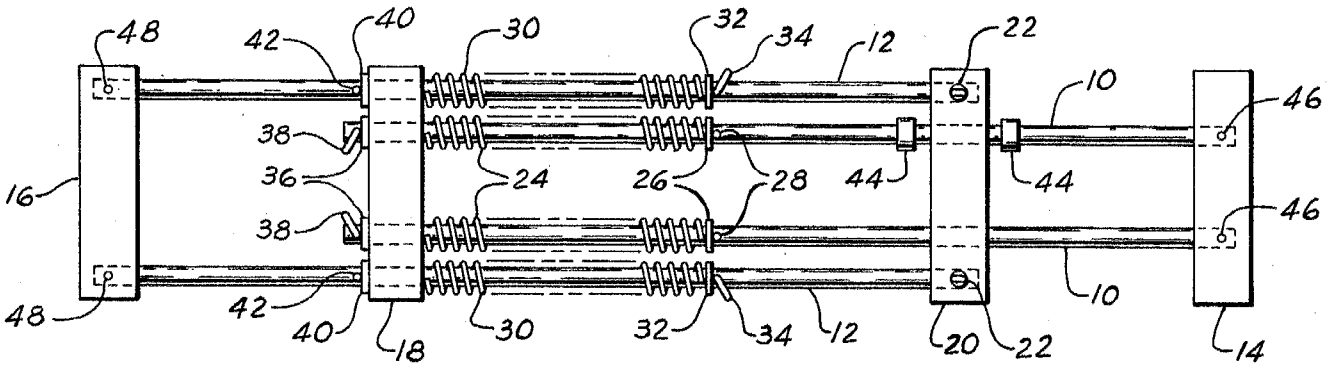
FIG. 2 is a plan view of the embodiment shown in FIG. 1.
Figure 5:
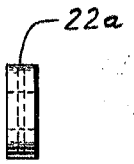
FIG. 5 is a side view of the snap washer shown in FIG. 4.
Figure 4:
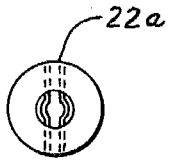
FIG. 4 is a plan view of a snap washer used on the end of the pull pin shown in FIG. 3.
Figure 3:
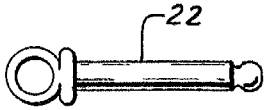
FIG. 3 is an enlarged side view of the pull pins shown in FIGS. 1 and 2.

The device shown in FIGS. 1 and 2 generally comprises a first pair of hollow rods 10, and a second pair of hollow rods 12 having inner end portions which overlap each other, and outer portions which project to handles 14 and 16, respectively. The handles 14 and 16 are fastened to their respective rods in a permanent manner by pins 46 and 48 respectively. In the embodiment shown in FIGS. 1 and 2, the rods 10 and 12 are positioned in a common plane and a first transverse bar 18 extends across the rods adjacent to the inner ends of the first pair of rods 10. The bar has suitable openings therethrough through which the respective rods 12 pass and through which the rods are free to slide. A second transverse bar 20 extends across the bars at the inner end of the second pair of rods 12. The transverse bar 20 has sockets in which the ends of the bars 12 are received, and the transverse bar 20 is secured to each of the rods 12 by means of pull pins or detachable locking keys 22. The second transverse bar 20 also has openings extending therethrough and through which the rods 10 pass to guide the rods 10 with respect to the rods 12.

A first pair of coil springs 24 are telescoped over respective ones of the first pair of rods 10, with one end in engagement with the first transverse bar 18. The opposite ends of the coil springs 24 are abutted by washers 26, which in turn are held against the springs 24 by pins 28.

A second pair of coil springs 30 have their respective members telescoped over respective ones of the second pair of rods 12, with one end in engagement with the first transverse bar 18. The opposite end of the coil springs 30 are abutted by washers 32 held in place by spring detent pull-pins 34. The inner ends of the first pair of rods 10 are prevented from being withdrawn outwardly of the first transverse bar 18 by a similar pair of washers 36 and spring detent pull-pins 38. The first transverse bar 18 is held in engagement with the coil springs 30 by means of a pair of washers 40 and pins 42.

The rods 12 are spaced sufficiently far apart that an individual's foot can be placed between the rods and over the handle 16 while the handle 14 is grasped by the individual's hand. When the handle 14 is pulled upwardly, washers 36 push the first transverse bar 18 upwardly to compress the springs 30 against the washers 32. When the individual presses downwardly, rods 10 slide through the second transverse bar 20, and the washers 36 separate from the first transverse bar 18, which is held in position by the washers 40. This foreshortening pf the device compresses the coil springs 24.

In the preferred embodiment, the device is approximately two and one half feet long, and so the handle 16 can be held in one hand and the handle 14 in the other. The device can then be either extended or compressed to exercise the abductor or the adductor muscles in both arms. Collars 44 are positioned on one of the rods 10 on opposite sides of the second transverse bar 20 to provide an indication of how far one handle has been moved relative to the other. The collars 44 have a friction fit with respect to the rod and by positioning both collars against the bar 20, they will be slid along the rod 10 a distance corresponding to the movement of the rod through the bar 20.

When it is desired to increase the effort which the patient exerts, springs 24 and 30 are removed and replaced by another pair of springs having the same length and inside diameter, but of a higher spring rate. This is done by first pulling spring detente pull pins 34 and 38, removing washers 36, and removing the locking keys 22. The handle 14 can then be grasped and the rods 10 pulled outwardly of the bar 18. The bar 20 is pulled off of the ends of the rods 12 and the coil springs 30 can then be slid off of the inner ends of the rods 12, after removing washers 32. The springs 30 are replaced by stiffer springs and the washers 32 and spring detente pull pins 34 are reinstalled. The coil springs 24 will drop off of the ends of the rods 10 and the new springs 24 can be slid onto the ends of the rods 10 and the ends of the rods 10 slipped back through the bar 18. The washers 36 and spring detente pull pins 38 are installed and the second transverse bar 20 is slid over the ends of the bar 12. The detachable locking keys 22 are then reinstalled. Assembly is then complete.

In order to increase the range of motion over which the device can be used, a short length of rope 50 or a strap can be provided with a loop in one end into which the exerciser passes his foot. The other end of the rope is fastened to bar 14 with a simple knot or adjustable fastener, so adjusted as to vary the distance between the exercise device and the exerciser's foot. The exerciser can then grasp bar 16 and proceed with his exercise program while in a standing position. By lengthening the rope occasionally, the range of motion through which he employs the device is changed to gradually involve different sets of muscles in ever varying degrees. The same rope or strap can be used to tie the device to any secure anchor point, thereby allowing the exerciser to work against it in any direction, be it horizontal, vertical, overhead, behind or below him.

It will be seen that the unit can be partially taken apart and the individual members laid parallel for shipping in a convenient package. It will further be seen that a relatively lightweight compact unit is provided which can exercise practically all muscles of the body so the unit can be taken to the patient's room, and can be left there for his use. This avoids the necessity of having personnel taking him to a physical therapy room where still other personnel help him with cumbersome single purpose exercising devices.

While the invention has been described in considerable detail, I do not wish to be limited to the particular embodiments shown and described; and it is my intention to cover hereby all novel adaptations, modifications, and arrangements thereof, which come within the practice of those skilled in the art to which the invention relates.

I claim:

1. An exercise device comprising: first and second pairs of parallel rods having inner overlapping ends and outer projecting ends, said second pair of rods straddling said first pair of rods, a first transverse abutment member on the inner ends of said first pair of rods and slidably receiving said second pair of rods, a second transverse member connecting the inner ends of said second pair of rods and slidably receiving said first pair of rods, a first pair of coil springs respective ones of which are telescoped over respective ones of said first pair of rods with the ends of the springs that are adjacent said first transverse member being positioned to receive compressive force from said first transverse member, first retainers fixed to said first pair of rods for opposing compressive force from the other end of said springs, a second pair of coil springs respective ones of which are telescoped over respective ones of said second pair of rods with the ends of the springs that are adjacent said first transverse member being positioned to receive compressive force from said first transverse member, second retainers positioned on said second pair of rods for opposing compressive force from the other end of said springs, third retainers for preventing said first pair of rods from being pulled out of said first transverse member, fourth retainers limiting movement of said first transverse member outwardly of said second pair of rods, and handles on the outer ends of said first and second pairs of rods, and whereby both pushing and pulling of said handles are opposed by compressive action of one or more of the springs.

2. The device of claim 1 wherein said second and third retainers are pull pin devices, and said second transverse member is fastened to said second pair of members by quick detachable means for permitting ready disassembly and replacement of said springs.

3. The device of claim 1 including: a pair of slidable devices having a friction fit with respect to said first pair of rods and respective ones of which are positioned on opposite sides of said second transverse member to indicate the limit of movement of one pair of rods with respect to the other.

4. An exercise device comprising: first and second pairs of parallel rods having inner overlapping ends and outer projecting ends, a first transverse member on the inner ends of said first pair of rods and slidably receiving said second pair of rods, a second transverse member on the inner ends of said second pair of rods and slidably receiving said first pair of rods, a first pair of coil springs, respective ones of which are telescoped over respective ones of said first pair of rods intermediate said transverse members, a second pair of coil springs respective ones of which are telescoped over respective ones of said second pair of rods intermediate said transverse members, one end of each said spring in each of said first and second pairs of springs being positioned to receive abutment forces from the adjacent one of said transverse members, and abutment means on said rods opposite the other ends of said springs for transferring abutment forces from respective springs to respective rods, and respective handles on the projecting ends of respective pairs of rods for applying tension and compressive forces to said rods.

5. The device of claim 4 wherein respective transverse members and all abutment means between the springs and the inner ends of the rods are attached to respective pairs of rods by quick disconnect devices facilitating replacement of the springs.

6. The device of claim 4 wherein said first and second pairs of rods are coplanar.

7. The device of claim 4 including a pair of slidable devices having a friction fit with respect to the rods slidably received by the one of said transverse members that is not positioned to receive abutment forces from said springs.

8. The device of claim 4 wherein said handles are detachable to permit disassembly to a state where its parts are in parallel touching engagement.

9. The device of claim 4 including third and fourth pairs of coil springs having the same length as said first and second pairs but of a different spring rate.

* * * * *